US009416523B2

(12) United States Patent
Usher

(10) Patent No.: US 9,416,523 B2
(45) Date of Patent: Aug. 16, 2016

(54) RETRO FLUSH TOILET

(71) Applicant: Norman Usher, Inglewood, CA (US)

(72) Inventor: Norman Usher, Inglewood, CA (US)

( * ) Notice: Subject to any disclaimer, the term of this patent is extended or adjusted under 35 U.S.C. 154(b) by 314 days.

(21) Appl. No.: 13/959,183

(22) Filed: Aug. 5, 2013

(65) Prior Publication Data

US 2015/0033462 A1 Feb. 5, 2015

(51) Int. Cl.
*E03D 1/24* (2006.01)
*E03D 3/02* (2006.01)

(52) U.S. Cl.
CPC ..... *E03D 3/02* (2013.01)

(58) Field of Classification Search
CPC ..... E03D 1/286; E03D 3/02
USPC ..... 4/332
See application file for complete search history.

(56) References Cited

U.S. PATENT DOCUMENTS 1,998,861 A * 4/1935 Campus ..... E03D 3/04 137/216
2,285,073 A * 6/1942 Zimmerman ..... E03D 3/10 4/362
3,060,450 A * 10/1962 Rupert ..... E03D 3/10 4/359
4,510,629 A * 4/1985 Jovy ..... E03D 3/10 4/332
5,832,546 A * 11/1998 Inch ..... E03D 3/00 4/333

* cited by examiner

*Primary Examiner* — Huyen Le
(74) *Attorney, Agent, or Firm* — Lawrence S. Cohen

(57) ABSTRACT

A flushometer toilet is used in a bathroom that has access to only a small diameter water supply pipe that usually would be useful only with a gravity toilet. A water storage apparatus (60) is provided that includes large diameter pipes (of 1.5 inches diameter) lying close to the flushometer valve (44) so at the beginning of a flushing, a large volume of water is available at a pressure of at least 30 psi.

6 Claims, 1 Drawing Sheet

RETRO FLUSH TOILET

BACKGROUND OF THE INVENTION

Homes typically have water pipes of ½ inch or ⅜ths inch diameter leading to each toilet. The toilet in each bathroom is commonly a gravity toilet connected to a home water supply pipe. The gravity toilet has a water closet, or tank, filled with water to a height such as 12 inches before each flushing. A gravity toilet relies upon the pressure of water resulting from the height of water in the water tank to move water into the toilet bowl for a flushing.

Many commercial buildings have water supply pipes of at least one inch diameter that carry water at a pressure of at least 30 psi. The water from such pipes flows through a flushometer valve, or high flow flush valve, directly into the toilet bowl and generates a better flushing than does a gravity toilet. However, the pressure of water decreases rapidly as the diameter of the home water supply pipe decreases. If the flushometer valve receives water directly from a ½ inch diameter water supply pipe, a poor flushing results, and the toilet outlet often creates a stoppage and must be cleaned out. A system that allowed a small diameter home water supply pipe to supply water that flows vigorously enough through a flushometer valve (high flow flush valve) and toilet bowl to create a good flushing, would be of value.

SUMMARY OF THE INVENTION

In accordance with one embodiment of the invention, a water storage apparatus is provided that allows a high flow, or flushometer toilet with a flushometer valve to be used successfully with a ½ inch home water supply pipe. The typical home water supply pipe has a diameter of ½ to ⅜ths inch and carries water at a pressure such as at least 30 psi. The water storage apparatus includes a large diameter pipe (at least ¾ inch diameter, such as 1.25 to 1.5 inch diameter) extending a considerable distance (extending most of the distance) such as at least 6 inches (and preferably at least 20 inches) between the ½ inch home water supply pipe and the flushometer valve inlet, with the large diameter pipe carrying the water at at least 30 psi. When a flushing begins, the high initial pressure such as 30 psi decreases relatively slowly because a considerable volume of water (at least 10 cubic inches) at the high pressure of at least 30 psi lies close (within 10 inches) to the flushometer inlet.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
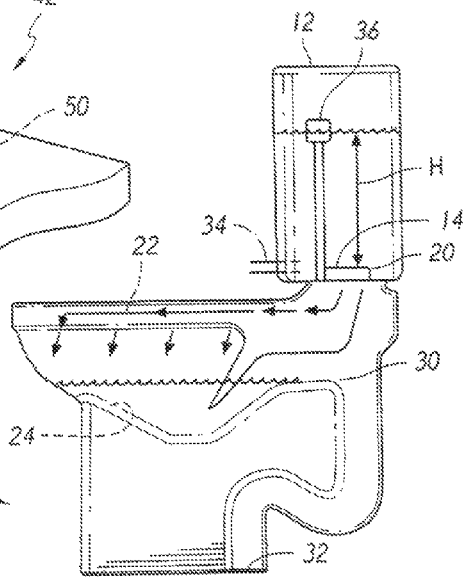
FIG. 1 PRIOR ART
FIG. 1 is a sectional side view of a prior art home toilet.

FIG. 1 shows a prior art home gravity toilet 10 which includes a water closet, or storage tank, 12 that stores flushing water at a height H such as 12 inches above an outlet 14. When a flush valve 20 is opened, water passes from the water closet through a water tunnel 22 into a toilet bowl 24. The water passes through a trap 30 and out though a drain 32. After each flushing, water from a home water supply pipe 34 refills the water closet through a valve 36. The flushing water moves out of the water closet and into the toilet bowl, resulting in a less than vigorous flushing so waste may be trapped in the trap.

Figure 2:
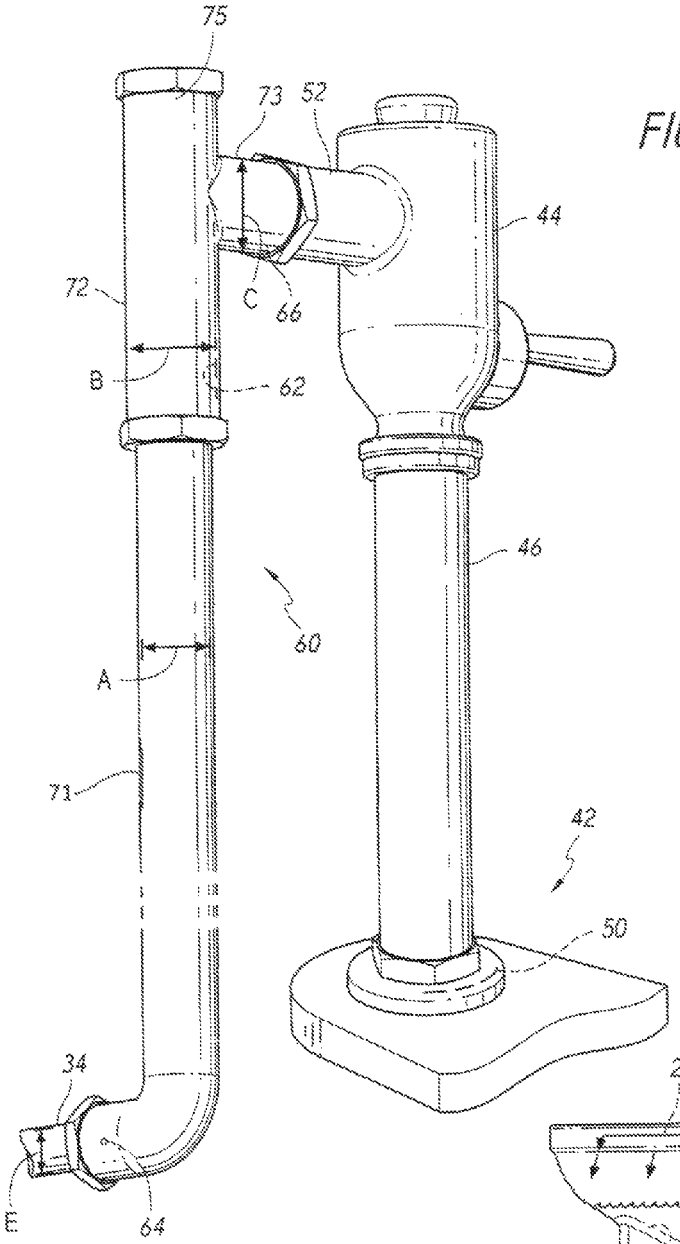
FIG. 2 is a partial side elevation view of a high flush toilet view of the present invention.

FIG. 2 shows part of a high flush or flushometer toilet 42 that includes a high flow flush valve, or flushometer 44, that has a fluid connector 46 connected to a toilet inlet 50. If high pressure water, such as water at at least 30 psi, flows directly from a one inch or 1¼ inch or greater diameter pipe into the valve inlet 52, then a good flushing usually will occur. However, if the only water supply is a home water supply pipe 34 of a diameter E of 0.5 inch, then a good flushing is unlikely to occur. This is because the pressure of water at the toilet bowl inlet 50 will decrease rapidly during a flushing.

Applicant assures a good flushing even though the water source is a home water supply pipe 34 of 0.5 inch diameter, by adding a water storage apparatus 60. The water storage apparatus 60 stores water at a pressure of at least 30 psi in a water storage volume 62 that extends between points 64, 66. The stored water has a volume of at least 10 cubic inches and preferably at least 20 cubic inches and this volume lies within 20 inches of the flushometer valve inlet 52. The water storage volume includes the volume of first, second, and third conduits 71, 72, and 73 that extend from the home water supply pipe 34 to the flushometer inlet 52. An additional short pipe 75 extends upward. At the beginning of a flushing, water at 30 psi flows rapidly within the conduits to begin a vigorous flushing. The fact that a lot of water (at least 10 cubic inches) lies at a high pressure (30 psi or higher) close (within 20 inches and preferably within 10 inches) to the flushometer inlet 52, results in the pressure of water at the flushometer inlet decreasing more slowly. The pipe 71 which lies between 10 and 25 inches from the home water pipe 34, also helps maintain a high water pressure until near the end of the flushing, but its effect is secondary.

The three pipes 71, 72, 73 that extend from the ½ inch home water pipe 34 to the 1.5 inch flushometer inlet 52, have inside diameters A, B, C of at least 0.75 inch, and preferably 1.0 inch, with B being at least 1.5 inches. This arrangement for a water pressure above 30 psi has been found to produce good flushings (no stoppage). Since the first two pipes 72, 73 are closest to the flushometer inlet, their diameters are of the greatest importance. The pipes 72, 73 have lengths of 5.8 inch and 1.5 inch, respectively.

Thus, the invention enables the use of a high flush toilet, or flushometer toilet, even though a large diameter pipe (over 0.75 inch diameter) is not available to supply a large flow rate of high pressure water directly from a home water supply pipe into the high flush valve. High pressure water is supplied to the high flush valve by an apparatus that includes a large volume conduit(s) that stores water at high pressure (at least 30 psi) very close to the high flush valve. The large volume is at least 10 cubic inches and preferably at least 15 cubic inch, and all lies within 10 inches of the high flush valve inlet.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for altering a home toilet to achieve better flushing, wherein the home toilet includes a toilet bowl housing with a toilet bowl (24), connected through a water tunnel (22) to a toilet bowl inlet (50), and the home toilet includes a water closet that lies on the toilet bowl housing and that has valves connected to a home water supply pipe (34) for storing water in the water closet and for releasing the stored water to flow by gravity into the water tunnel at the top of the toilet bowl, comprising:

removing the water closet and connecting a water supply arrangement (60) between the home water supply pipe (34) and said toilet bowl inlet (50), wherein said water supply arrangement includes a manually operable flushometer valve (44) and at least one storage pipe (71, 72, 73) with a volume in the at least one storage pipe which is a greater volume than would be in the same length of home water supply pipe and is of at least 15 cubic inches lying within 10 inches of said flushometer valve, with water at a pressure of at least 30 psi filling said at least one storage pipe wherein the at least one storage pipe is connected between the pressurized home water supply and the flushometer valve to provide in a static condition a sealed uninterrupted continuation of pressurized water supply from the home water supply pipe to the flushometer valve so that upon flushing the greater volume in the at least one storage pipe will flush and when the flushometer valve has closed after a flush the water supply arrangement is instantly repressurized to the static condition.

2. The method described in claim 1 wherein:

said step of connecting a water supply arrangement between the home water supply pipe (34) and the toilet bowl inlet (50) comprises establishing a large diameter pipe (72) of a diameter of at least 1.5 inches and length at least twice its diameter so an end of said large diameter pipe connects directly to said flush valve.

3. A method for altering a home toilet to achieve better flushing, wherein the home toilet includes a toilet bowl housing with a toilet bowl, connected through a water tunnel to a toilet bowl inlet, and the home toilet includes a water closet that lies on the toilet bowl housing and that has valves connected to a home water supply pipe for storing water in the water closet and for releasing the stored water to flow by gravity through the toilet bowl inlet into the water tunnel at the top of the toilet bowl, comprising:

removing the water closet and connecting a water supply arrangement between the home water supply pipe and said toilet bowl inlet, wherein said water supply arrangement includes a manually operable flushometer valve and connected as a continuous sealed water conduit between the home water supply pipe and the flushometer valve at least one storage pipe being larger in diameter than the home water supply pipe with a volume in the at least one storage pipe of at least 15 cubic inches lying within 10 inches of said flushometer valve, defining a static condition with water at a pressure of at least 30 psi in said at least one storage pipe; and wherein upon flushing the water in the at least one storage pipe will flush while the at least one storage pipe will continue to be filled and provide flow by water flow from the home water supply pipe until the flush is completed whereupon the water supply arrangement will be instantly restored to the static condition ready for flushing.

4. The method of claim 3 wherein said step of connecting a water supply arrangement between the home water supply pipe and the toilet bowl inlet comprises said at least one storage pipe has a diameter of at least ¾ inch and a length at least twice its diameter and having an an end of said at least one storage pipe connected directly to said flush valve.

5. The method of claim 4 wherein the length of the at least one storage pipe is from 6 inches to 20 inches.

6. The method of claim 4 wherein said at least one storage pipe has a diameter of at least one inch.

* * * * *